US006092534A

United States Patent [19]

Cheung

[11] Patent Number: 6,092,534

[45] Date of Patent: Jul. 25, 2000

[54] HAIR ROLLER ASSEMBLY

[76] Inventor: Jeremy Chi Kong Cheung, Flat F, 12/F, Block 4, Beacon Height, 4 Lung Ping Road, Kowloon, The Hong Kong Special Administrative Region of the People's Republic of China

[21] Appl. No.: 09/176,857

[22] Filed: Oct. 22, 1998

Related U.S. Application Data

[63] Continuation-in-part of application No. 09/062,775, Apr. 20, 1998, Pat. No. 5,901,711.

[51] Int. Cl.[7] ..... A45D 2/12; A45D 1/02

[52] U.S. Cl. ..... 132/226; 132/227; 132/212

[58] Field of Search ..... 132/226, 227, 132/212, 262, 223, 245, 250, 256, 246, 253

[56] References Cited

U.S. PATENT DOCUMENTS

| | | | |
|---|---|---|---|
| 3,675,663 | 7/1972 | Calandra | 132/226 |
| 4,569,360 | 2/1986 | Glucksman | 132/226 |
| 4,576,188 | 3/1986 | Barradas | 132/226 |
| 4,598,722 | 7/1986 | Doyle | 132/226 |
| 4,699,159 | 10/1987 | Thaler | 132/226 |
| 5,286,949 | 2/1994 | Simons | 219/222 |
| 5,482,060 | 1/1996 | Barradas | 132/226 |
| 5,522,408 | 6/1996 | Wiegner | 132/262 |
| 5,901,711 | 5/1999 | Jeremy | 132/226 |

*Primary Examiner*—John J. Wilson
*Assistant Examiner*—Robyn K Doan
*Attorney, Agent, or Firm*—Sidney N. Fox, P.C.; Sidney N. Fox

[57] ABSTRACT

A hair roller assembly formed of a light-weight, concentricaly arranged porous flexible tubular outer sleeve of plastic woven fabric-like material, perforate at least semi-flexible resilient tubular plastic inner support sleeve and a concentrically arranged perforate tubular intermediate sleeve formed of highly heat conductive material and between said outer and inner sleeves, said sleeves being surface to surface engaged with the outer sleeve positively secured to the perforate tubular inner support sleeve and said outer sleeve having spaced bands of outwardly extending flexible filament projections provided with hair-grasping hook-shaped ends.

18 Claims, 2 Drawing Sheets

HAIR ROLLER ASSEMBLY

REFERENCE TO PENDING PRIOR APPLICATION

This application is a continuation-in-part of my patent application Ser. No. 09/062,775 filed Apr. 20, 1998 now U.S. Pat. No. 5,901,711 and entitled "ONE PIECE HAIR ROLLER" amended to read "HAIR ROLLER ASSEMBLY".

FIELD OF THE INVENTION

The herein invention relates generally to the hair treatment and styling field and more particularly provides a shape retaining cylindrical hair roller for receiving and retaining strands of hair wrapped therearound during a heat treatment process and having empirically improved heat conductivity to transmit heat from a heat source to the hair yet capable of distributing the surface heat sufficiently to permit handling thereof without burning the operator.

BACKGROUND OF THE INVENTION

Hair rollers of many different constructions have been well known to the hair treatment and styling field. Many are not sufficiently heat conductive to enable satisfactory hair curling. A hair roller should be light in weight and capable of maintaining its shape when wound with hair and subjected to the heat of a hair dryer during use. The hair roller should be capable of absorbing high heat from a hair dryer when wound with hair and, as well, quickly transmitting the heat to the hair. Accordingly, the hair roller should be highly heat conductive yet should avoid become excessively hot so as to pose a danger of burning either the hair or scalp of the subject being treated or the operator's hands during the process of setting the subject's hair during drying or styling thereof.

Past proposals to assure that the hair roller maintains its shape under exposure to high heat and moisture, as well as the tightness with which the hair strands to be treated are often wound around the hair roller. Under such conditions, light-weight hair rollers often tend to at least partially collapse loosing their shape and causing the wound hair to loosen, perhaps shifting its position along the hair roller. Avoidance of such occasion requires the use of fastening means, such as clips or hair-pins, increasing the weight of the wound hair roller. Considering the substantial number of hair-wound hair rollers which are employed in the setting and drying of hair for styling thereof, the weight of the total employed results in considerable discomfort to the subject being treated, and, as well, increases the length of time the subject must undergo the heating procedure.

In addition, many hair rollers are provided with highly heat conductive materials, such as solid heat conducting cores, such as formed of relatively thick heat conductive metals or solid rods to increase the heat conductivity of the hair roller. This solution to the heat conductivity problem has the disadvantage of increasing the weight and/or bulk of the hair roller limiting their use at least partially because of their weight and/or bulk.

Another problem faced with many of the presently available hair rollers is the difficulty encountered in maintaining engagement of the hair strands to the roller. The hair, even though wound apparently securely to the roller, often will loosen, portions separating from the roller or shifting position along the hair roller prior, during or immediately following the conclusion of the treatment process when portions of the wound hair can separate from the hair roller. Constructions utilizing the Velcro-type or hook and pile materials have been proposed for holding the hair onto the hair roller. Such materials may require greater heat conductivity to be achieved since heat leakage is often encountered due to the increased porosity of the available structures. Further, maintaining such materials onto the hair roller often requires the use of adhesives for holding these materials in place. While advantageous as solutions for some encountered problems, the other problems are incurred. The ability to utilize such materials efficiently has been a goal in the design and construction of hair rollers. Likewise, efficient use of high heat conductivity materials with satisfactory heat retention characteristics and structural consistency while avoiding the above described problems, also has been an unmet goal in this art.

Many available hair rollers are limited to a pair of cylindrical elements, one to secure hair to the second element. Loss of one or the other of these individual elements often is encountered so that many excessive number may be required to be on hand for replacement use over a period of time. Additionally, the two element hair rollers have experienced inadequate heat transfer from the heat source to the hair. Even rollers which are heated by multiple heating rod units or by immersion in heated moisture chambers have not sufficiently solved the problem of satisfactory heat retention over the distance from the heating source to the hair, that is, preserving the heated hair rollers against heat loss. Preservation of good heat transfer is essential. Some offered solutions to this problem have been to insert a high heat conductor within the hair roller in a form where a tubular the heat conductor expands its diameter to press upon the surrounding tubular holder around which the hair strands are wound. This requires provision of a relatively thick tubular holder. Then, there is the difficulty of securing the hair to the holder. One solution offered is to provide unitary teeth molded as a part of the exterior of the tubular holder. However means must be provided to hold the heat conductor in place within the holder. The weight of the resulting holder then becomes a disadvantage.

In addition, there has been difficulty in holding the hair strands to the hair roller. So-called hook and pile means, such as embodied in Velcro (a registered trademark of American Velcro) type material have been utilized. Some applications of Velcro-type material have involved full coverage of the outer surface of the hair roller. This has found to restrict the flow of heat to the hair and/or unevenly to distribute the heat flow unevenly over the extent of the hair carried by the hair roller. Other efforts have provided for direct contact between the heat transfer medium and the hair supported thereon. Such efforts may result in instances the hair rollers become too hot to handle and/or cause damage to the hair and possible injury to the operators.

It also would be advantageous to provide a lightweight efficient hair roller which is economical to manufacture and, as well, which could be manufactured to provide varied sizes without sacrificing weight limitations, het conductivity characteristics or their shape retaining capabilities. The manufacturing process for the hair rollers should be easily capable of producing hair rollers having the varied number of sizes required without material change of the manufacturing procedure and should be capable of mass production.

Among the examples of hair rollers offered by the prior art, attention is directed to the following:

| | |
|---|---|
| Frederics | 1,827,785 |
| Prince et al | 3,723,219 |
| Leasure | 4,025,375 |
| Catania | 3,073,318 |
| Thomas et al | 4,330,351 |
| Denebeim | 5,515,874 |
| Kim | 5,660,192 |
| Denebeim | 5,515,874 |
| Dietze | 5,713,380 |
| Solomon | 3,540,357 |
| DeMystral | 3,267,942 |
| Simons | 5,286,949 |
| Calandra | 3,675,663 |
| Glucksman | 4,569,360 |

Solomon provides a hair roller having a perforated cylindrical tubular open-ended metal core as a supporting member and a woven fabric layer of heat resistant material disposed about the outer circumferencial surface of said metal core, the woven fabric layer having yieldable hooks extending outwardly therefrom releasably to catch and hold the strands of hair in use as well as to hold the roller securely in position upon the hair. The core is formed of heat conductive metal such as aluminum, brass or even steel. The material layer when applied to the core has abutting longitudinal opposite edges defining a seam which is secured as by sewing to itself so as to form a tubular sleeve on the core or may be linearly slidably mounted on the core. The thus constructed cylindrical woven fabric material layer move longitudinally along the core unless adhesively secured on the core. The woven fabric material can be formed of a single longitudinal layer or can be formed of individual longitudinal layers arranged side by side with different hook configurations carried by the central sleeve and the end sleeves respectively. The Solomon hair roller has core extensions for the purpose of heating. The hooks appear constituted as Velcro type split-loops. The metal core is intimately engaged with the heating element. Solomon even suggests a solid core element for bottom heating and increased heat conduction.

With Solomon, the hair roller is formed of two elements, the heat conducting core and the heat resistant outer sleeve which can be slidably engaged longitudinally on the core. The outer hooks are arranged in bands along the longitudinal length of the fabric layer with the end bands being thicker, leaving areas of exposed fabric material. The adherence of the spaced hooks may not be as satisfactory as having a continuous hooked layer without a spaced array along the longitudinal length of the roller.

Opposite ends of the core are exposed when the material layer is applied thereto. Apparently, while heat is conducted from the inner core, the outer sleeve carrying the hooks may be too heat retentive. The fabric defines a relatively heavy slidable member which retains heat while the bands of hooks are said to help in maintaining the shape of the hair roller. The fabric layer covers the core and has raised pile threads with hook-shaped yieldable ends. The core is heat conductive and yet retains heat instead of transmitting such heat to the hair wound upon the outer layer. The core is heavy enough to retain heat and hence not only is a relatively poor heat transmitter but adds considerable weight to the hair roller, as does the relatively thick conductive metal layer when employed. Many metals, such as aluminum, brass and steel are employed in such thickness as will achieve high heat conductivity. However, such usable results in increased weight so that the increased heat conductivity is outbalanced by the increased weight.

DeMestral provides a fabric hair roller having an open-ended cylindrical body provided with holes to allow moisture to escape. The body of the DeMystral is formed out of fabric having flexible outwardly extending erect strands provided with ball formations or "bulges" at their ends. Warp filament threads, preferably formed of nylon, are provided in the fabric strip to form the foundation of the fabric so that the body is "suffiently" rigid to maintain its shape. These threads are formed into reinforcement rings spaced along the longitudinal length of the body, and can have a large section which can be distributed over the whole length of the body as reinforcement. The body is said to be collapsible yet elastic enough to resume its cylindrical shape after collapse. However, the DeMystral unit is not heat conductive and hence is limited to be used in consort with a hair dryer—simply functioning to hold the hair curl in place under a hair dryer.

Another hair roller is proposed by Frederics which is formed of a perforated outer tube of heat transmitting metal foil and an inner tube of paper. The roller is slidably placed over hair strands which are wound upon a circular mandrel which is the heat source, the inner paper sleeve has bands which are gas impervious and bands which are gas previous, the heated gases in the mandrel apparently comprise the heat source and serves to support the roller in use. This proposed hair roller is believed non-practical for use with the modern type of multiple rod heaters. No support sleeve is provided. A woven porous outer sleeve is provided which carry hair retaining hooks for holding hair strands on the roller. Heat is transferred directly through the hair without space being provided between the hair and the heat conductor—the outer metal sleeve. Teachings were absent that would teach the provision of a material comprising a multilayer sandwich material formed into a hair roller. Catania provides a hair roller formed of a spiral wire "tube" enclosing a brush with a twisted member having a plurality of outwardly extending bristles. A crossed mesh member is disposed upon the spiral wire with the bristles extending therethrough. The bristles are intended to function to hold the hair strands in position as the hair is wound around the spiral lattice wire shell. However, the bristles to not appear to function efficiently to hold the hair strands in position on the Catania wire shell. However, Catania's arrangement requires particularly structured, articulated clip-on members which are required to retain the hair which is wound upon the roller. The special hair clip is a necessary component of the combination provided by Catania and is provided with means to pass through the spiral wire tube to aid in maintaining the hair in position as well as performing their apparently prime function of connecting the hair rollers one to the other. The Catania hair clip not only is alleged to retain the hair in position but secures a pair of the rollers (with hair wound thereon) together one alongside the other or end to end. The securement of the hair rollers to each other in such manner is an essential element of the combination taught by Catania. The roller itself is likely to lose its shape notwithstanding its structure being formed as open latice-work. With the spiral wire, there also is a likelihood that the roller would lose its shape in handling. No provision is made to provide satisfactory heat conduction from the interior of the roller outward to the hair where the hair is wound held in place on the outer shell.

Thomas et al provides a hair setting roller formed of an outer, generally cylindrical cage formed of resilient plastic material, the cage comprising a pair of end rings and a plurality of longitudinal strips spaced one from the other about the circumference of the cage. The strips are provided with bristle-like projections for gripping the hair wound about the cage. An inner core is introduced into the cage. The inner core is fabricated from a heat retaining material and is adapted to be inserted into the cage. The inner core is hollow and is adapted to be fitted onto an electrically heated post or peg of a multi-curler heating device. As mentioned above, the core is a heat retaining device not a heat conductive device. Preferably, said core is hollow and is adapted to contain a heat-retaining fluid of high thermal capacity. The hair is wound around the cage and a hair-pin is introduced through the wound hair into the cage to trap the hair. The hair-pin is held by the longitudinal strips of the outer cage, contacting the core tangentially. Again, while there is heat provided, any heat conductive metal element is absent.

Benebeim provides a hair styling arrangement comprising a spherical body formed of a pair of outer hemispheres formed of plastic material, the body having a Velcro material covering at least a portion of the outer surface of the plastic spherical body. A interior body of light-weight thermally conductive metal is positioned within the plastic outer body and has an axial passage therethrough for receiving a heating-element. The hemispherical halves of the body have a central opening and are assembled to form the spherical body with the interior metal sphere therein. Notwithstanding the hook-shaped gripping elements of the Velcro coating carried by the outer spherical body, the hair is held in place by a spring clip. The resultant spherical hair curler is clearly distinct from a cylindrical hair roller in function and operation.

Dietze has provided a cylindrical hair roller having a plastic core with Velcro tape wound around it and one of a metal, metal-coated, metallized carbon or anti-static filaments arranged as a shield over the surface of the cylindrical core, the filaments being wound over the plastic core. No highly heat conductive element is included.

Kim provides a self-sticking hair roller having a solid core formed of a closed cell foam and a self-gripping tape which covers or sheaths the roller around the center portion thereof, the tape is provided with a wide ring pushed onto the cylindrical core having Velcro-like outwardly projecting hooks or bristle like protrusions but still covers only the central portion of the roller leaving considerable hook-free space inward of both ends of the roller.

Kim's tape is pushed in the form of the wide ring onto the soft-foam plastic roller core and retained thereon due to its annular width which is adapted to a respective diameter of the roller. Kim does suggest additional fastening of the central band by adhesive bonding or welding. Kim also suggests the self-gripping tape can be formed with "mushroom" protrusions which can be formed into mushroom shaped hooks by heating. The bristles function simply to retain the hair strands in position as same are wound around the spiral wire outer shell the hair strands to the rollower-where clip-on members which can pass through the spiral wire tube and grasp hair strands.

Simons provides a hair roller formed of a thick walled hollow imperforate cylinder having an enlarged head portion and a perforate molded cage suitable for slidable engagement on the thick-walled imperforte cylinder. Simons suggests that the exterior surface of the cage can carry flocking, bristles or hook & pile material on its outer surface as an intimate part thereof. While hook & pile material is mentioned, there appears no teaching as how to provide same other than binding it to the exterior surface of the cage. The cage is a plastic molded member having nothing to do with the heating of the roller or heat transfer to the hair.

The Simons roller is heated by moist hot air and then has hair strands and then has hair strands wound thereon. A resilient hair-clip is provided to claim on the roller and hair wound thereon after the hair is applied to the purpose of holding hair in place on the roller. There is no high heat conductive intermediate medium, layer or material, between the thick hollow central cylinder. The recited purpose of the structure is to provide for good heat retention. Provision for assuring good heat transfer to the hair does not appear to be made. The hair-grasping means for holding the hair to the roller body is simply a coating providing hair-grasping hook-shaped "fingers" on the exterior surface of the perforate roller, said "fingers" and surface which requires cooperation with the resilient clip to hold the hair in place after the hair has been wound on the perforate roller. The resilient clip is provided with a coating of "hair-grasping" material on its inner surface, said coated inner surface performs no other purpose but to bind it to the exterior surface of the cage which is a plastic molded member having nothing to do with the heating of the roller or heat transfer to the hair.

Simons fails to suggest a third, outer sleeve or equivalent element. There is no outer sleeve in Simons which is secured to the inner cage and functions as a hair grasping member, as well as means to protect the user against handling the hot hair roller. The enlarged head provided on the thick walled cylinder functions to support the hair roller while it is seated in a rack within the heating chamber (or box). The clip suggested by Simons does not contribute to heat transfer to the hair. The clip is provided to hold the user's hair in place on the roller. There is no metal intermediate sleeve, layer or material between the thick hollow central cylinder. While there is provision for heat transfer, there is no provision for assuring good heat conduction to the hair. The hair-grasping means provided by Simons for holding the hair to the roller body is simply a coating on the exterior surface of the roller body, said coating providing hair-grasping hook-shaped "fingers" on the exterior surface of the perforate roller body which requires cooperation with the resilient clip to hold the hair in place. Note that the "hair-grasping" material does not function as an outer sleeve of a concentrically arranged three sleeve hair roller body including a inner plastic support sleeve, an intermediate highly heat conductive sleeve and an outer hair-grasping plastic woven sleeve carrying hair-grasping flexible hook-shaped filaments.

Calandra provides a hair roller construction comprising a cylindrical mandrel made of plastic. A Velcro fabric composed of spiral alternating lengths of side by side hook and pile wound "fabric" is applied to the exterior surface of the mandrel in a band adjacent the opposite ends of the perforate mandrel, a portion of such "fabric" extends over the edge of the opposite ends of the mandrel and extends a considerable distance within the inner surface of the mandrel engaged with said inner surface, providing means to secure the rollers one to the others, either "end to end" or "side to side" or both. The "fabric" does not function as "hair-grasping means", and, in fact, the hair is not held by this hook and pile material. No means for improving heat conductivity to the hair wound around the mandrel other than the perforations carried by the mandrel. Calandra does comprise only two members, the perforate sleeve (the mandrel) and the hook and pile outer end strips of the spiral wound hook and pile strips at the opposite ends of said mandrel. No inner support for the mandrel is provided.

SUMMARY OF THE INVENTION

The invention provides a hair roller assembly formed of concentrically arranged a thin porous plastic woven filament tubular outer sleeve, an inner perforate tubular plastic inner supporting sleeve and a highly heat conductive perforate tubular sleeve, said thin porous plastic woven filament tubular outer sleeve having radially outwardly extending flexible projections terminating in plural flexible filament ends having hooked shaped flexible hair-grasping ends.

The plastic woven porous outer sleeve can be ultrasonically positively secured directly to the inner perforate supporting sleeve along a split formed across the width of the intermediate sleeve.

DESCRIPTION OF PREFERRED EMBODIMENT

The hair roller assembly 10 is formed of concentrically arranged surface to surface engaged an outer tubular sleeve, an inner plastic perforate tubular support sleeve and an intermediate perforate tubular perforate sleeve therebetween. The outer tubular sleeve is formed of a porous woven plastic material having plural spaced circumferential rows each including a plurality of radial outwardly extending flexible projections having hair-grasping hook shaped ends. The intermediate sleeve is formed of a highly heat conductive material such as thin aluminum foil or thin aluminum sheet. The intermediate sleeve has plural rows of perforations along its width. The inner plastic support sleeve has a plurality of openings of generally like rectangular configuration, plural spaced longitudinal strips and plural spaced circular coaxial ridges or rings intersecting said strips to define the plural openings. The openings permit air to penetrate through the hair roller and, as well, permit fastening means, such as hair pins and other objects to pass through the roller for securing the hair to the hair roller after having been wound thereabout. The completed hair roller is lightweight.

Figure 4:
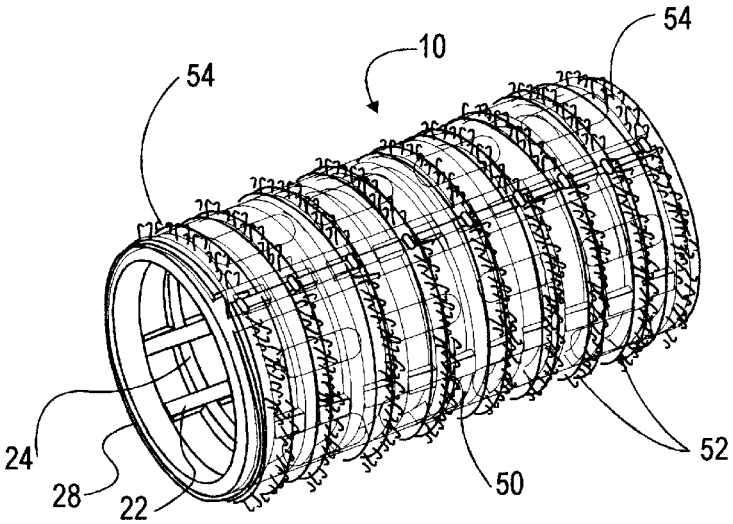
FIG. 4 is a perspective view of the hair roller of the invention subsequent to complete assembly thereof; and, FIG. 5 is an end view of the assembled hair roller of FIG. 5A is a magnified sectional detail representation taken from the circled portion of FIG. 5.

Referring first to FIG. 4 of the drawing, the hair roller of the invention is designated generally by reference character 10 and is illustrated in fully assembled form. The preferred form of the hair roller 10 is cylindrical in configuration and is open-ended. The hair roller 10 is formed as a tubular three-layer sandwich formed of a inner plastic support sleeve 12, an intermediate high heat conductive metal foil sleeve 14 and an outer sleeve 16 which is formed of a plastic woven Velcro-like fabric-like tape that is a self-sticking porous woven plastic fabric-like tape 18 carrying spaced woven foundation bands having a plurality of outwardly projecting hair grasping Velcro-like plastic filament projections terminating in hook-shaped flexible hooks 20 formed by outwardly extending plastic loops which are severed to define said outwardly extending filament hooks 20. The foundation structures can comprise mono-filament bonded longitudinal strands woven into continuous closely spaced plastic filament cross-strands.

Figure 1:
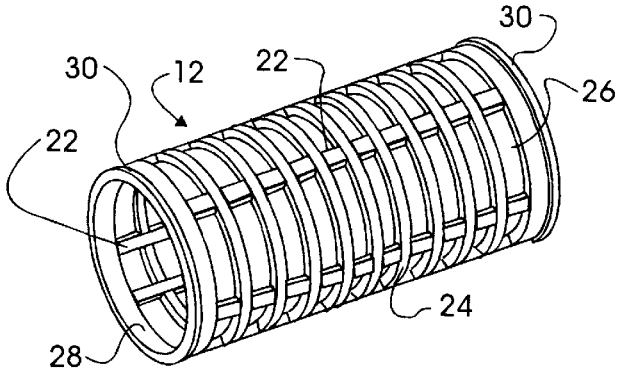
FIG. 1 is a perspective view of the plastic inner support sleeve member of the hair roller assembly according to the invention.

Referring to FIG. 1, the tubular plastic inner support sleeve 12 is open-ended, perforate along its length and has limited flexibility and resilience. The inner plastic support sleeve 12 is formed as by injection molding as an open-ended open-network of cylindrical configuration defined by plural longitudinal rows of like thin strips 22 arranged parallel and equispaced along the longitudinal length of the plastic inner support sleeve 12 and plural equispaced spaced circular coaxial inner rings 24 which are unitary with said longitudinal strips 22 at their intersections, the strips 22 bridging the spaces between the rings 24 and may be formed of thin short lengths having ends joined to the next adjacent short length. The rings 24 are unitary with the longitudinal strips 22, said strips and rings defining a plurality of windows 26 arranged regularly to complete the open-network along the longitudinal length of the tubular plastic inner support sleeve 12. The windows 26, preferably, are rectilinear in configuration. The thickness of strips 22 and the circular rings 24 are the same.

The tubular plastic inner support sleeve 12, although having limited resilience, has sufficient strength and rigidity to support both the intermediate and outer sleeves, as well as supporting, in use, the hair strands (not shown) which are intended to be wrapped around the hair roller 10 when said hair roller is in use for setting, styling or drying the hair. Although the plastic inner support sleeve 12 is sufficiently rigid to support the intermediate and the outer sleeves, it's limited resilience permits it to be forcibly partially collapsed if necessary to place it within the open-End of the hair roller enabling assembly thereof. The limited resilience of said plastic inner support sleeve 12 enables said sleeve to have a structural memory to enable its return to its normal, tubular configuration. The opposite ends 28 of the plastic inner support sleeve 12 may be formed of coaxial circular unitary end rings 24' which may be of a uniform continuous width slightly greater than the width of the rings 24. The inner surfaces of the coaxial spaced circular rings are planar, and preferably are co-planar with the inner surfaces of the strips 22. The exterior facing surface of each of the rings 24 may be planar or may be rounded (not shown). The end rings 24' preferably may have inner and outer planar surfaces as shown. The end rings 24' have a thickness slightly greater than the rings 24 and, additionally, may include raised narrow border rims 30 having a thickness slightly greater than the thickness of the strips 22 and rings 24. Each narrow raised border rim 30 extends outward from the circumference of the tubular plastic inner support sleeve 12, functioning to contribute to the strength of the tubular plastic inner support sleeve 12 as well as to limit any tendency for slidable movement of the intermediate and outer layers of the hair roller 10.

Figure 1A:
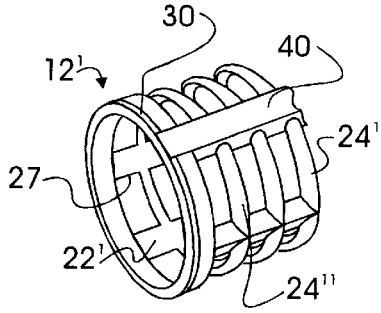
FIG. 1A is a fragmentary perspective view of a modified plastic inner support sleeve member of the hair roller assembly according to the invention.

Referring to FIG. 1A, there is illustrated a fragmentary detail of a modified tubular plastic inner sleeve 12' differing from the sleeve 12 in that one strip 40 is selected to be rectangular and thicker than the other strips 22', matching the thickness of the rings 24'. The strips 22' all have coplanar inner surfaces. The rings 24' all have coplanar inner surfaces and a rounded outer surface represented in FIG. 1A by reference character 24". Thus the overall inner surface within the tubular perforate plastic inner sleeve 12 is smooth. The strip 40 preferably extends longitudinally along the width of the sleeve 12' parallel to the other strips 22'. The longitudinal strips 22' of the modified tubular plastic inner support sleeve 12' have a exterior center portion which tapers toward the outer longitudinal. edges of said sleeves 22' to define longitudinal thin edged thin wing-like portions 27, as shown in FIG. 1A, the longitudinal strips 22' being wider than the longitudinal strips 22. The thin wing-like portions 27 may serve as a form of baffle to improve the flow of air, as well as moisture, if necessary, through the hair roller 10.

Figure 2A:
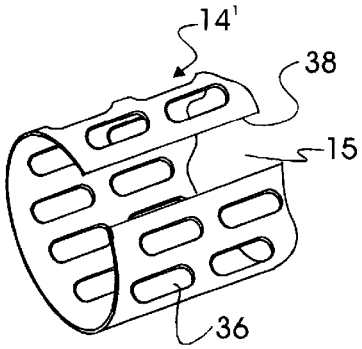
FIG. 2A is a perspective fragmentary view of a modified electrically conductive intermediate layer which is preformed and capable of being slidably or snap mounted upon the inner sleeve shown in FIG. 1.
Figure 2:
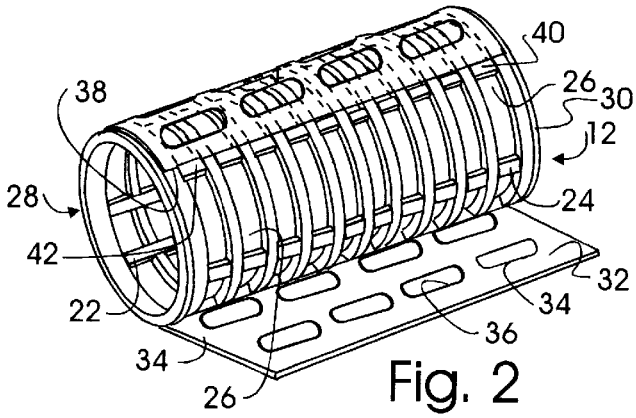
FIG. 2 is a perspective view illustrating the hair roller according to the invention shown in the process of assembly of the electrically conductive intermediate layer of the hair roller according to the invention shown in the process of mounting the conductive layer to the mounted intermediate layer on the inner sleeve.

Referring to FIG. 2, the hair roller 10 is illustrated in the first stage of its assembly process during which the intermediate sleeve 14 is illustrated as being applied to the tubular plastic inner support sleeve 12. The intermediate sleeve 14 comprises a thin rectangular sheet of highly heat conductive aluminum, aluminum alloy or other highly heat conductive material which may be in sheet form or in foil form. The aluminum foil or sheet 32 is provided with spaced rows 34 of equispaced generally like openings 36 formed along the length thereof. The openings 36 may be of oval, oblong, rectangular, square or other selected configuration but preferably are generally uniform in configuration.

The aluminum foil or sheet foil 32 is selected preferably to have a thickness of about 0.2 mm to 0.4 mm. so as to be light in weight. The foil or sheet 32 is rectangular in configuration with its ends 38 squared and is cut to a selected length suitable for the particular diameter of the plastic inner support sleeve 12 and of the hair roller 10 to be formed. The selected length of the resulting perforate foil sheet 32 preferably is slightly less than the outer circumference of the plastic inner support sleeve 12 substantially to cover same so that when the perforate sheet 32 is wound upon the cuter circumferential surface of the tubular inner plastic support sleeve 12, the opposite ends 38 of the perforate metal foil sheet are spaced apart a distance substantially equal to the width of said strip 40 of the strips 22 of the plastic inner support sleeve 12, thus defining a space area 42 exposing the outwardly facing surface of said one strip 40 of the outer circumferential surface of said tubular plastic inner support sleeve 12.

In FIG. 2, the hair roller 10 is illustrated in the process of applying the foil sheet 32 to the outer circumferential surface of the tubular plastic inner support sleeve 12 thereof. The tubular plastic inner sleeve 12 has been formed, preferably by injection molding technique. The tubular plastic inner support sleeve 12 is placed upon the high heat conductive metal foil sheet 32 and rolled thereover, starting at the one edge of the one strip 40 of the tubular plastic inner support sleeve 12, wrapping the metal foil sheet 32 around the outer circumferential surface of the tubular plastic inner support sleeve 12 until the end 38 of the metal foil sheet 32 reaches the opposite edge of said one strip 40, leaving the outer surface of strip 40 of the cylindrical plastic sleeve exposed and the space area 42 defined.

In FIG. 2A a modified intermediate metal sleeve 14' is illustrated which is preformed into a generally cylindrical configuration split longitudinally so that the free ends 38' thereof spaced apart to define a gap 15. The modified intermediate metal sleeve 14' is formed of aluminum strip of a thickness about 0.02–0.03 inches(0.4 mm) and is resilient so that it either can be slidably engaged over the tubular plastic inner support sleeve 12 or spread and snapped over said plastic inner support sleeve 12 along the latter's longitudinal length between the border rims 30 thereof, the intermediate metal sleeve is held in place by its resilience with the space area 42 exposed.

Figure 3:
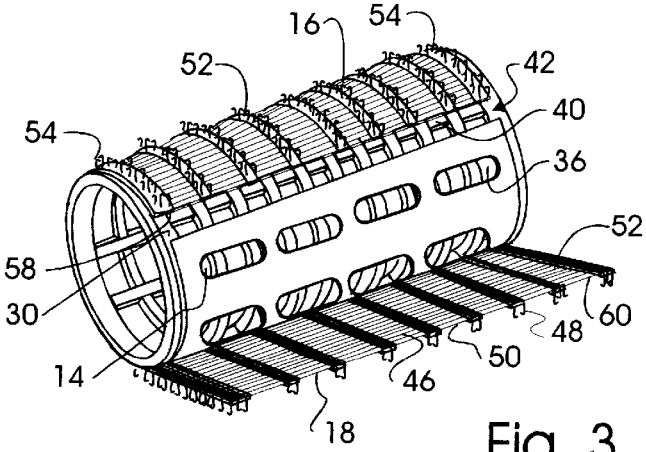
FIG. 3 is a perspective view of the hair roller according to the invention shown in the process of assembly of mounting the outer layer to the mounted intermediate layer of the hair roller.

Now, referring to FIGS. 3 and 4, once the intermediate sleeve 14 has been formed by wrapping the foil sheet substantially around the outer circumferential surface of the cylindrical plastic inner sleeve 12, the hair roller 10 is ready for the final stage of the process of formation by applying the outer sleeve thereto. The outer sleeve 16 of the hair roller 10 comprises a woven fabric-like tape 44 having a warp 46 and a weft 48. The weft 48 is formed of a plurality of very fine plastic filaments 50 arranged in parallel very closely spaced across the width of the woven fabric-like tape 44. Preferably, the weft filaments are continuous. The warp 46 is formed of spaced narrow bands 52 of fabric-like material longitudinally upon the array of fine plastic filaments and extending longitudinally the length of the woven fabric tape 44. The weft 48 also includes border edge bands 54 of the same woven fabric-like material which form the bands 52, said border edge bands 54 being wider than the bands 50. Each of the bands 52 and 54 are formed with a plurality of outwardly extending plastic filaments 56 along the length of the woven fabric-like tape 44. The filaments 56 are greater in diameter than the fine filaments 50 forming the weft 48 of the woven fabric-like tape 44. The filaments 56 may be formed as closed loops (not shown) extending outward from the bands 52 and 54, said loops being cut to define plural outwardly extending projections terminating in flexible filament hook shaped ends defining hooks 20 which function to grasp and hold the hair strands of hair which are to be wound around the hair roller 10 for use thereof.

Figure 5:
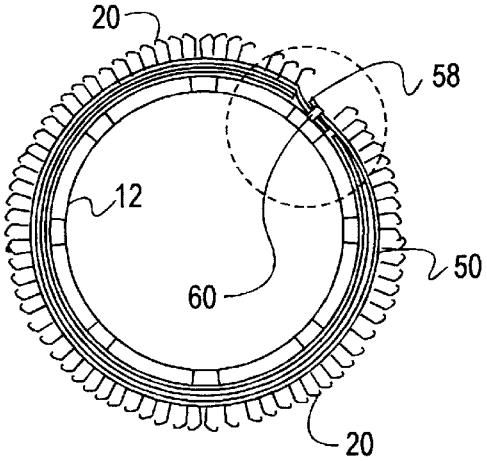
Figure 5A:
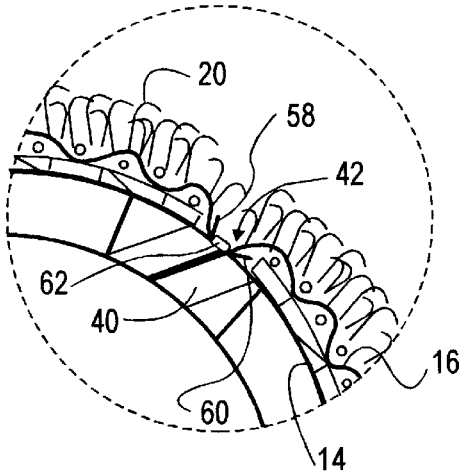

As illustrated in FIG. 3, the assembled intermediate and inner plastic sleeves 14 and 12 is placed across the width of said woven fabric-like tape 44, said woven fabric-like tape 44 having been cut to a length slightly longer than the circumference of the assembled intermediate sleeve 14 and the inner plastic sleeve 12. The resulting woven fabric-like tape 44 is arranged resting upon the weft 48 thereof along a horizontally disposed surface. The assembled concentrically arranged sleeves 12 and 14 are placed across the width of the woven fabric-like tape 44 length and, starting at one initial edge 58 thereof being applied to the assembled sleeves 12 and 14 overlapping the edge of the foil sheet 32 adjacent the exposed surface of space area 42 of the one strip 40 of said tubular plastic inner sleeve 12 and extending over said exposed surface of space area 42. The assembled sleeves 12 and 14 are rolled over the weft 48 of the woven fabric-like tape 44 so that the filaments 50 adhere to the underlying surface of the high heat conductive aluminum-alloy foil 32, and so that the opposite end 60 of the woven fabric-like tape 44 overlaps the opposite end of the woven fabric-like 44 which was initially overlapping the portion of the exposed space area 42 of the strip 40. The overlapping portions of the woven fabric-like tape 44 consisting of ends 58 and 60 are ultrasonically bonded (see the ultrasonic weld designated by reference character 62 in FIG. 5A) to the underlying longitudinal exposed surface of the sleeve 40 within space area 42, said welds 62 being spaced along the length of said exposed surface of strip 40 so as permanently to adhere the woven fabric-like tape 44 to the plastic inner support sleeve 12 thereby forming the concentrically arranged outer sleeve 16, intermediate foil sleeve 14 and inner plastic support sleeve 12 as an assembly which constitutes the hair roller 10 of the invention. The overlapped edges 58 and 60 of the outer sleeve 16 constituted by the woven fabric-like material 44 also shown in FIG. 5A as displaying the outwardly extending hooks 20. The woven fabric-like tape can be a VELCRO-TAPE, VELCRO being the trademark of American Velcro company.

It should be understood that the hair roller 10 according to the invention can be formed of many different lengths and diameters. Likewise, the hair roller 10 efficiently employs a light-weight highly heat conductive metal arranged on a distortion resistant inner plastic sleeve having some heat retention, the inner sleeve providing resistance to deformation or collapse of the hair roller. Other highly heat conductive metals or materials can be utilized with advantage. The woven porous fabric-like material with its fine filament woof-base provides a minimal intervening space which defines a path for transmitting the heat from the highly heat conductive intermediate sleeve to the hair mounted upon and held by the Velcro-type hooks carried by the plastic woven fabric-like material forming the outer sleeve of the hair roller 10. The operation of the hair roller of the invention is efficient. Further, the nature of the woven Velcro-type fabric-like tape holds both the hair and the hair roller in position, and, as well, holds adjacent hair rollers in position. The size of the openings or their number can be varied without adverse heat passage resulting, and, the outer sleeve is not likely to become so hot as to injurer bring discomfort to the subject or operator performing the treatment. Further, the hair roller in use is not likely to become to hot to handle by the said operator.

In addition to its function to support the outer and intermediate sleeves and hair wound upon said outer sleeve, the plastic inner sleeve serves as an insulator capable of preventing the heated hair roller from becoming too hot to handle, protecting the operator from being burnt.

It will be apparent to one of ordinary skill in the art that many changes and modifications in dimensions, Minor changes in dimensions, materials and construction can be made to the invention as described herein without departing from the spirit and scope of the invention as claimed.

What I claim is:

1. A hair roller assembly comprising:

a) an outer tubular sleeve, b) an inner plastic perforate support sleeve, c) a perforate tubular intermediate sleeve therebetween, d) said sleeves respectively being concentrically arranged surface to surface engaged respectively, and e) each having opposite open ends, f) said outer tubular sleeve formed of a porous woven plastic material having plural coaxial spaced circumferential rows, each row including a plurality of radial outwardly extending flexible projections having hair-grasping hook shaped ends, g) said intermediate sleeve being formed of a highly heat conductive material and having a gap across the width thereof defining a pair of opposite spaced edges whereby a portion of said plastic perforate tubular inner sleeve is exposed to said outer tubular sleeve along the width of said gap, said outer tubular sleeve being positives secured to said exposed portion of said perforate plastic inner support sleeve along said gap.

2. The hair roller according to claim 1 in which said intermediate tubular sleeve is formed of a sheet of high heat conductive material having a thickness ranging from 0.2 mm to 0.5 mm.

3. The hair roller assembly according to claim 1 in which said plastic perforate inner supporting sleeve is formed of plural spaced parallel plastic strips along the width of said sleeve and plural spaced substantially circular axially spaced rings between opposite ends thereof, said strips and rings being unitary, one of said strips having a greater thickness than the remaining strips, said rings at said opposite ends being wider and being of the same thickness as said one strip, the inner surfaces of said strips and rings being coplanar whereby the interior surface of said sleeve is smooth.

4. The hair roller assembly according to claim 3 in which in which said rings have a planar interior facing surface and a rounded exterior facing surface of said perforate tubular plastic inner supporting sleeve.

5. The hair roller assembly according to claim 3 in which said selected ones of said strips have a longitudinal center fold and are tapered laterally to define wing-like portions with thin edges.

6. The hair roller assembly according to claim 1 in which said outer tubular sleeve is formed of a length or porous woven plastic fabric-like material comprising a weft of fine plastic filaments closely parallel arranged across the width of said material and a warp formed of plural spaced parallel longitudinal bands along the length of said material, said material being formed to a tubular form, each of said bands formed of plural outwardly extending flexible plastic having said plural outwardly extending flexible filament projections having said hair-grasping hook-shaped ends.

7. The hair roller assembly according to claim 6 in which said weft extends over the side edges of said intermediate sleeve.

8. The hair roller assembly according to claim 6 in which said filaments of said weft extend over the edge of said intermediate sleeve.

9. The hair roller assembly according to claim 6 in which said bands adjacent the opposite ends of said roller are wider than the intervening bands and extend over the edges of said intermediate sleeve at opposite ends of said roller when assembled to said concentrically arranged intermediate sleeve.

10. The hair roller assembly according to claim 1 in which said perforate tubular plastic inner support sleeve has raised rims along the opposite ends thereof, said raised rims limiting sideways movement of said concentrically arranged sleeves.

11. A flexible resilient hair roller assembly comprising an outer tubular sleeve and a perforate resilient semi-flexible plastic supporting tubular inner sleeve and a highly heat conductive tubular intermediate sleeve, said sleeves having opposite ends and being concentrically arranged surface to surface engaged with said highly heat conductive intermediate sleeve between said outer tubular sleeve and said perforate resilient semi-flexible plastic inner supporting sleeve;

said outer tubular sleeve is formed of a porous woven plastic material having plural circumferentially spaced narrow relatively narrow rows formed of a plurality of radially outwardly extending flexible hair-grasping projections along the width thereof;

said intermediate sleeve being formed of thin aluminum and having plural spaced openings formed in spaced rows along the circumferential surface thereof, said intermediate sleeve having a gap extending across the width thereof;

said inner plastic perforate supporting sleeve having plural spaced strips extending longitudinally along the length thereof and plural coaxial spaced substantially circular rings extending along the length of said inner plastic perforate supporting sleeve and unitary with said spaced plastic strips thereby to define plural openings between opposite ends of said tubular supporting sleeve, at least one of said strips being thicker than the remaining plastic strips; and, said gap of said intermediate sleeve being coincident with said thicker one of said remaining plastic strips, said porous plastic woven outer tubular sleeve being positively secured bonded to said thicker one of said strips of said tubular plastic perforate inner supporting sleeve.

12. The hair roller assembly according to claim 11 in which said porous plastic woven outer sleeve is sonically welded through said gap of said intermediate sleeve to said thicker one of said strips of said inner plastic perforate supporting sleeve.

13. The hair roller assembly according to claim 12 in which selected ones of said remaining strips have a wing-like cross-section tapering into thin opposite longitudinal edges.

14. The hair roller as claimed in claim 11 in which said outer tubular sleeve is formed of a length of a porous woven plastic fabric-like material comprising a weft of fine plastic filaments closely spaced parallel arranged across the width of said material and a warp formed of plural spaced parallel longitudinal bands along the length of said warp, each of said bands formed of plural fine side-by-bide joined plastic filaments having plural outwardly extending flexible filament projections having hair-grasping hook-shaped ends, said woven plastic fabric-like material formed into tubular form having opposite ends, said bands each having said plurality of outwardly extending hair-grasping projections terminating in hook-shaped flexible hair grasping ends.

15. The hair roller according to claim 14 in which said bands adjacent said opposite ends are wider than the intervening bands.

16. The hair roller according to claim 14 in which said woven porous material has a length longer than the circumference of said intermediate sleeve and said plastic supporting sleeve, said woven porous material having opposite overlapping ends when formed into said tubular form, said overlapping ends being ultrasonically bonded to said thickened one of said plastic strips of said tubular plastic inner sleeve.

17. The hair roller according to claim 14 in which said overlapping ends are ultrasonically welded to said thickened one of said plastic strips.

18. The hair roller according to claim 16 in which said overlapping ends are ultrasonically spot welled to said one of said plastic strips.

* * * * *